US005429188A

United States Patent [19]

Cameron et al.

[11] Patent Number: 5,429,188

[45] Date of Patent: Jul. 4, 1995

[54] TUBING ROTATOR FOR A WELL

[75] Inventors: Dennis Cameron; Linden Bland, both of Alberta, Canada

[73] Assignee: Jorvik Machine Tool & Welding Inc., Elk Point, Canada

[21] Appl. No.: 175,045

[22] Filed: Dec. 29, 1993

[51] Int. Cl.[6] ..... E21B 33/04

[52] U.S. Cl. ..... 166/78; 166/117.7

[58] Field of Search ..... 166/68, 73, 78, 117.5, 166/369

[56] References Cited

U.S. PATENT DOCUMENTS

| | | | |
|---|---|---|---|
| 1,560,984 | 11/1925 | Gorbutt . | |
| 1,650,102 | 11/1927 | Tschappat . | |
| 1,965,907 | 7/1934 | Pierce . | |
| 2,178,700 | 11/1939 | Penick et al. . | |
| 2,294,061 | 8/1942 | Williamson . | |
| 2,471,198 | 5/1949 | Cormany . | |
| 2,595,434 | 5/1952 | Williams . | |
| 2,599,039 | 6/1952 | Baker . | |
| 2,630,181 | 3/1953 | Solum . | |
| 2,693,238 | 11/1954 | Baker . | |
| 2,788,074 | 4/1957 | Brown . | |
| 3,075,584 | 1/1963 | Brown . | |
| 3,100,538 | 8/1963 | Sanders . | |
| 3,643,737 | 2/1972 | Current et al. . | |
| 3,805,894 | 4/1974 | Giroux | 166/369 |
| 4,278,278 | 7/1981 | Chambless et al. . | |
| 4,601,343 | 7/1986 | Lindsey, Jr. et al. . | |
| 4,630,688 | 12/1986 | True et al. | 166/78 X |
| 4,716,961 | 1/1988 | Makins, Jr. et al. | 166/78 X |
| 4,844,171 | 7/1989 | Russell . | |
| 4,993,276 | 2/1991 | Edwards | 166/78 X |
| 5,139,090 | 8/1992 | Land . | |
| 5,327,961 | 7/1994 | Mills | 166/78 X |
| 5,327,975 | 7/1994 | Land | 166/78 X |

OTHER PUBLICATIONS

National Oilwell Canada Ltd., "Variperm Packers", catalogue, marked received Dec. 13, 1993.

Rotating Production Systems, Inc., "Rotating Tubing Hangers", catalogue, undated, pp. 6–8.

Stream-Flo Industries Ltd., Wellhead Catalogue, undated, pp. 1–2, 14–20.

Graham, Marc and Brown, Charlie "Tubing Rotator System Increasing Pumping Unit Tubular Life," *Petroleum Engineer International,* Oct. 1993, pp. 46–47.

Bock Specialties Inc., catalogue, undated, pp. 1–16.

*Primary Examiner*—Ramon S. Britts

*Assistant Examiner*—Frank S. Tsay

*Attorney, Agent, or Firm*—Bennett Jones Verchere

[57] ABSTRACT

An improved tubing rotator is mounted to the casing bowl of a well, for rotating a tubing string extending down the well. A swivel dognut assembly is provided, comprising inner and outer sleeves. The tubing string is suspended from the inner sleeve which is rotatably supported from the stationary outer sleeve. The outer sleeve is adapted to be suspended from the tapered inner surface of the casing bowl, and is restrained from vertically upwards displacement by holddown screws. The outer sleeve is almost entirely contained or recessed within the casing bowl. A housing is bolted onto the casing flange. A pair of worms extend through the housing and driveably engage a ring gear associated with the inner sleeve. Because the sleeves are seated in the casing bowl, a compact rotator assembly is obtained. In addition, the tubing rotator is designed to permit the housing to be removed and a blowout preventer ("BOP") to be installed for well servicing while continuing to maintain a seal between the swivel dognut assembly and the casing bowl, thus sealing the annulus and preventing an otherwise possible blowout. The swivel dognut assembly can subsequently be removed with the tubing string through the BOP.

14 Claims, 3 Drawing Sheets

TUBING ROTATOR FOR A WELL

FIELD OF THE INVENTION

The present invention relates to an improved tubing rotator comprising a gear drive and a two-sleeve swivel dognut assembly which physically blocks the casing annulus when the drive is removed.

BACKGROUND OF THE INVENTION

In recent years, the use of downhole rotary pumps driven by rotating rod strings has enabled the production of oilwell fluids containing considerable quantities of entrained sand. However, the rotating rod string contacts and wears the wall of the tubing string. The sand in the fluid makes the wear more severe, which in the worst case results in formation of a hole. Use in a slant hole further encourages the rod string to lay on the tubing wall, aggravating the wear.

Assemblies which slowly rotate the tubing have been known since the 1950's as a means to distribute the wear, thereby prolonging the life of the tubing string. Generally, prior art tubing rotators commonly comprise the following components:

—a generally tubular housing adapted for connection to the casing bowl flange of a wellhead;

—a hollow drive shaft which extends down through the housing and is connected at its lower end to the tubing string;

—the drive shaft being rotatably supported from the housing with a thrust bearing; and —a drive means extending into the housing, said drive means having a gear attached to the drive shaft, for rotating the drive shaft and the attached tubing string.

The prior art is typified by assemblies disclosed by U.S. Pat. No. 2,696,238, issued to Baker and by the publications and products of Rotating Production Systems, Inc., of Denver, Colo., specifically the Rotating Tubing Hanger model LRH-1S/HD.

The Rotating Production Systems' assembly embodied in model LRH-1S/HD rotates the drive shaft with a single worm which extends into the housing to driveably engage a drive shaft-mounted ring gear. The rotating drive shaft and suspended tubing string are supported from the housing. The drive shaft extends upwards through the housing for connection to a swivel, which enables connection to the non-rotating wellhead components. The swivel is an inherently weak assembly. Further, the drive shaft and swivel protrude from the housing, significantly increasing the height of the wellhead components.

The Baker assembly uses a manual barring technique to rotate the drive shaft. The non-rotating wellhead components are secured to the housing.

Several disadvantages are associated with both of the Baker and Rotating Production Systems assemblies.

Of greatest significance is the risk of a blowout when wells fitted with these tubing rotators are serviced. Servicing the well requires removal of the rod and tubing strings. Even though the well is "killed" by filling it with heavy fluid prior to servicing, there is a risk of a "kick" associated with removing the tubing string. The gas pressure in a subsurface formation may build up and eject or "kick" the fluid out of the wellbore. It is a standard safety procedure to mount a blowout preventer (BOP) to the casing bowl during servicing. The tubing string is subsequently pulled out through the BOP.

In the assemblies of Rotating Production Systems and Baker, the tubing string is suspended from the housing. When the well is to be serviced, one must begin by unbolting the housing from the casing flange. The housing and suspended tubing string are then lifted upwardly and supported on a set of slips. The housing, the hollow shaft and the rotary drive assembly are then removed. This procedure is characterized by the following disadvantages:

—the upper end of the annulus of the well is temporarily open when the housing is unbolted and lifted;

—the lifting of the tubing string can disturb sand in the annulus at the base of the tubing string; and —the formation may then produce the "kick", sending fluid upwardly through the annulus at a time when there is no closure or seal at the top of the annulus.

With the foregoing in mind it is desirable to provide a tubing rotator having the following characteristics:

—a capability for removing the tubing rotator housing without lifting the tubing string;

—a capability to install the BOP after removal of the housing while maintaining closure of the annulus; and —a capability to pull the remaining tubing rotator related components through the BOP with the tubing string.

In addition, it is desirable to provide a tubing rotator that is compact and does not protrude above the casing bowl to the extent that the prior art assemblies do.

SUMMARY OF THE INVENTION

In accordance with the present invention, an improved tubing rotator is provided for rotating a tubing string extending down a well.

More particularly, a swivel dognut assembly is provided, comprising inner and outer sleeves. The tubing string is connected to and suspended from the lower end of the inner sleeve. The inner sleeve is rotatably supported on means such as a thrust bearing seated in the bore of the stationary outer sleeve and is preferably vertically secured to the outer sleeve with a removable locking ring. The outer sleeve is adapted to be seated in and suspended from the tapered inner surface of the casing bowl, and is sealed thereto.

Preferably, a pair of opposed, substantially parallel-axis worms driveably engage a straight-cut ring gear attached to the inner sleeve's upper end. The worms extend through the structural housing which is secured to the flange of the casing bowl.

Preferably, seals at the upper and lower ends of the inner sleeve seal to the housing and outer sleeve respectively, thereby excluding tubing and annular fluids from the drive means and thrust bearing.

Conventional non-rotating wellhead components are secured to the top of the housing.

In particular, the improved tubing rotator exhibits significant advantage over the prior art devices when installing a BOP to service the well. In preparation, the housing can be easily removed as the worms cleanly disengage from the straight-cut ring gear. Without the housing, the swivel dognut assembly continues to be physically restrained within the casing bowl with conventional holddown screws extending through the casing bowl flange. Thus the annulus remains sealed, preventing a kick and possible blowout while the BOP is lowered over the upper end of the inner sleeve and is secured to the casing bowl. The holddown screws can then be retracted, enabling removal of the swivel dognut assembly and the tubing string through the BOP.

Thus the invention comprises:

—a swivel dognut assembly, having a stationary outer sleeve adapted to be substantially contained within the casing bowl bore, to be suspended from the tapered portion of the bore surface and to seal against the inner surface of the casing bowl, said outer sleeve supporting bearing means on its inner surface, said assembly having an inner sleeve seated on the bearing means so that the inner sleeve is rotatably supported by the bearing means and outer sleeve;

—said inner sleeve being connectable at its lower end to the tubing string;

—holddown means being operative when engaged to restrain the outer sleeve to the casing bowl, to prevent vertical upward displacement;

—a generally tubular housing being connectable to the casing bowl flange;

—drive means, associated with the housing, for rotating the inner sleeve; and

—as a preferred feature, disengagable means for locking the inner and outer sleeves together so that the housing and part of the drive means can be disconnected and removed from the casing bowl while the tubing string and swivel dognut assembly remain restrained in the casing bowl to seal the annular space formed between the tubing string and the well casing, whereby a BOP may be lowered over the first means to engage the casing bowl.

DETAILED DESCRIPTION OF THE PREFERRED EMBODIMENT

Figure 1:
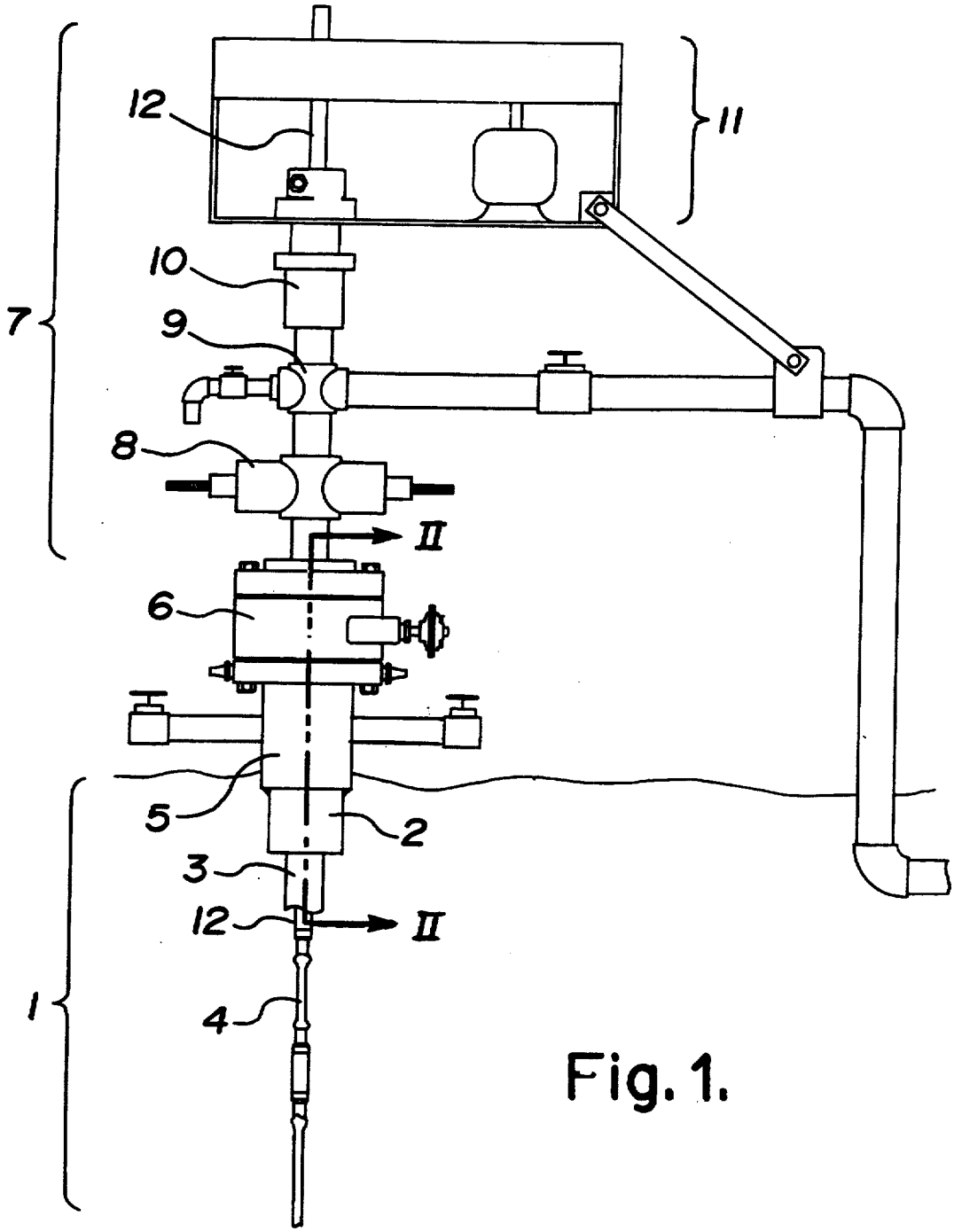
FIG. 1 is a side elevation of a conventional well and wellhead with the assembly of the present invention in place.

Referring to FIG. 1, a conventional well 1 is shown comprising a well casing string 2, a production tubing string 3 and a rotating rod string 4 extending downwardly inside the tubing string 3 to a downhole rotary pump (not shown). A casing bowl 5 is fixed to the top of the casing string 2.

A tubing rotator 6 is attached to the casing bowl 5. Wellhead components 7 are attached to the top of the tubing rotator 6 and typically comprise a rod BOP 8, a production tee 9, a rod stuffing box 10, and a rotary drive assembly 11. The rotary drive assembly 11 drives a polish rod 12 from which the rotating rod string 4 is suspended.

Figure 2:
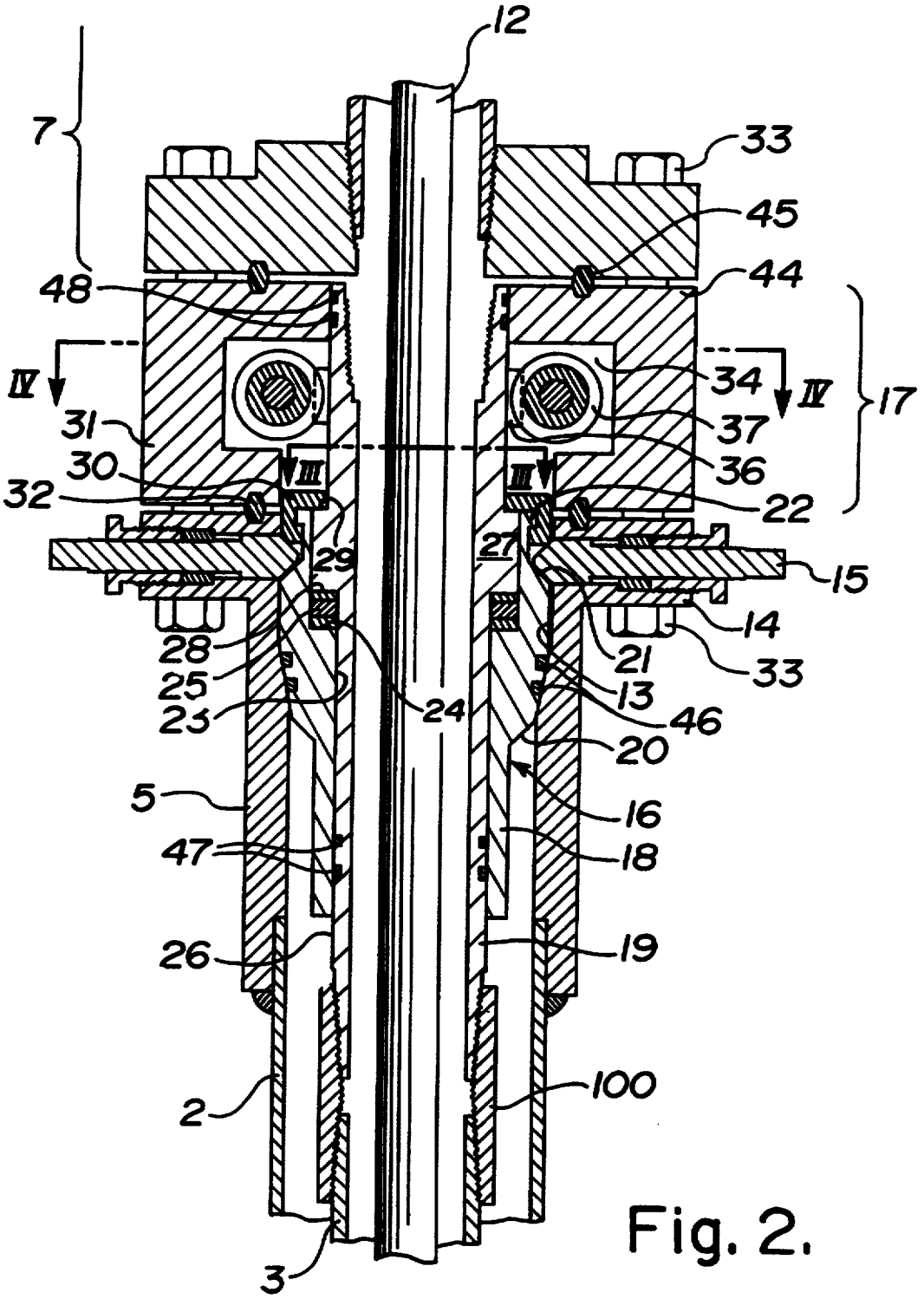
FIG. 2 is a cross sectional view of the tubing rotator along lines II—II of FIG. 1.

Having reference to FIG. 2, the casing bowl 5 has an internal bore having a tapered segment 13. The casing bowl 5 further has a connecting flange 14 and one or more holddown screws 15 extending through the flange 14 to the inner surface of the casing bowl bore.

The tubing rotator 6 comprises a two part swivel dognut assembly 16 and a drive means 17.

The swivel dognut assembly 16 comprises a stationary outer sleeve 18 and a rotating inner sleeve 19. The outer sleeve 18 has a contoured outer surface comprising a lower tapered surface 20, an intermediate shoulder 21, and an upper shoulder 22. The lower tapered surface 20 mates and substantially seals with the tapered segment 13 of the bore of the casing bowl 5. The intermediate shoulder 21 is positioned so as to be engaged by the holddown screws 15.

The bore of the outer sleeve 18 has a stepped internal surface 23, forming a shoulder 24 which supports a thrust bearing 25.

The inner sleeve 19 extends axially through the outer sleeve 18; the diameter of its outer surface 26 is substantially that of the bore of the outer sleeve 18. The outer surface 26 has a localized diameter change that forms an upset 27, intermediate along its length. The upset 27 forms a lower shoulder 28 which seats on the thrust bearing 25, and an upper shoulder 29 which substantially aligns with the upper shoulder 22 of the outer sleeve.

The tubing string 3 is connected to the inner sleeve 19 and is suspended therefrom with a tubing collar 100.

Figure 3:
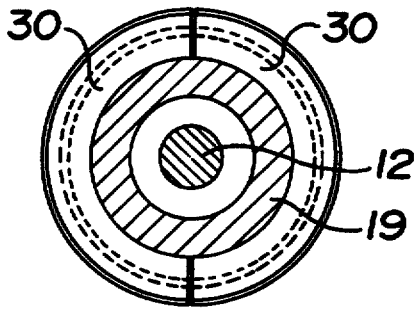
FIG. 3 is a overhead sectional view of the split retaining ring along lines III—III of FIG. 2.

A disengagable means comprising a transverse split retaining ring 30 encompasses the upper shoulder 22 of the outer sleeve 18 and overlies the upper shoulder 29 of the inner sleeve 19, for locking the inner and outer sleeves 19, 18 together. The ring 30 is bounded at its periphery by the inner surface of the casing bowl 5 which retains the split components of the ring 5 together, as seen in FIG. 3.

From the foregoing it is seen that the outer sleeve 18 is suspended from the casing bowl 5 by the tapered segments 13, 20. The holddown screws 15 are operative to engage the outer sleeve's intermediate shoulder 21, restraining the outer sleeve 18 from vertical upward displacement. The inner sleeve 19 is suspended from the outer sleeve 18 by the thrust bearing 25. The retaining ring 30 locks the inner sleeve 19 to the outer sleeve 18, restraining the inner sleeve 19 from vertical upward displacement.

The drive means 17 comprises a structural, generally tubular housing 31. The inner sleeve 19 projects above the casing bowl flange 14 and extends into the housing 31.

The housing 31 mates to the casing bowl flange 14 with a seal ring 32 and suitable bolting means 33. The housing 31 forms an inner cavity 34 within which operate rotative first and second means. The first means comprises a straight-cut ring gear 36, mounted on the inner sleeve 19. The ring gear 36 is machined integral with the inner sleeve 19.

The second means comprises two straight worms 37 mounted on opposing sides of the inner sleeve 19. The axes of the two worms 37 are substantially parallel and are perpendicular to the axis of the inner sleeve 19. The worms 37 are operative to driveably engage the ring gear 36. Two worms are provided to share the inherently higher point loading of the non-enveloping worm/ring gear contact. The straight-cut of the ring gear permits limited vertical misalignment of the ring gear 36 and worms 37.

Suitable gear lubricant is provided within the cavity 34.

Preferably, the worms 37 and the outer surface 26 of the inner sleeve 19 are hardened, particularly in the areas of the ring gear 36, upset 27, and outer surfaces 26, which are in contact with the outer sleeve 18 or housing 31.

The pitch of the worms 37 is less than 5° so that the drive means 17 is self-locking; that is, torsional forces on the tubing string 3 are unable to backspin the drive means 17.

Figure 4:
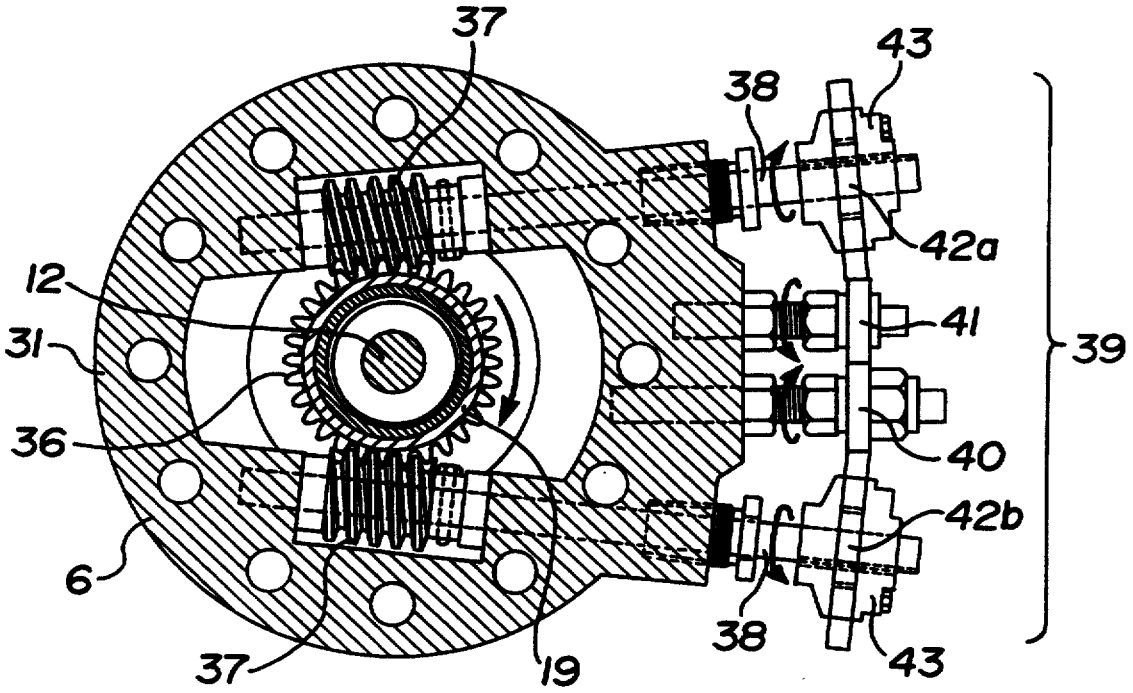
FIG. 4 is a cross sectional view of the drive housing along lines IV—IV of FIG. 2.

Having reference to FIG. 4, the worms 37 are mounted on shafts 38 which extend through the housing 31 from an activating gear set 39 of spur gears. The gear set 39 comprises an input gear 40, a change gear 41 and two output gears 42*a*, 42*b*. The output gears 42*a*, 42*b* are fitted with torque limiting clutch devices 43 such as those available from Browning, model T35L, ⅞" bore. The gear set 39 provides a 2.5:1 reduction and the worms 37 to ring gear 36 provide a 30:1 reduction for an overall input gear 40 to tubing string 3 gear reduction ratio of about 70:1.

Referring again to FIG. 3, it is preferable that the upper surface of the housing 31 forms a flange 44 for connection to the non-rotating wellhead components 7. This adaptation avoids the need for an exposed swivel connection, resulting in a stronger attachment and a lower wellhead profile. A seal ring 45 seals the tubing string fluids.

First seal means 46 are provided for sealing the outer sleeve 18 to the casing bowl's inner surface 13, preventing weeping of annulus fluids into the housing cavity 34. Second seal means 47 are provided between the surfaces 26, 23 of the inner and outer sleeves 19, 18, located below the thrust bearing 25, thereby isolating the bearing 25 from tubing string fluids. Third seal means 48 are provided between the inner sleeve 19 and the housing 31 above the cavity 34, for further isolating the housing cavity from tubing fluids.

To rotate the tubing string 3, the user manipulates the input gear 40 in a clockwise (CW) manner. The left output gear 42*b* rotates counter clockwise (CCW). The change gear 41 rotates CCW, driving the right output gear 42*a* CW. The same pitch, same hand worms then both drive the ring gear 36 in a CW rotation, consistent with tightening of the tubing collars 100 to the tubing string 3. The ring gear 36 rotates the inner sleeve 19 which in turn rotates the tubing string 3.

Overload torque on one worm 42*a* or 42*b* causes the torque limiting devices 43 to slip until the other worm 42*b* or 42*a* picks up an equal load, thereby sharing the high load between the two worms 37. The overload torque is set to avoid overtorquing of the tubing collars 100.

To install a BOP during servicing, the well is killed. The rod stuffing box is replaced with a rod BOP and the polish rod 12 and rod string 4 are removed. The wellhead components 7 are then removed to access the drive housing 31 of the tubing rotator 6.

The housing 31 is lifted axially from the inner sleeve 19 and the two worms 37 disengage from the straight-cut ring gear 36 without a need to displace the worm shafts 38. The inner sleeve 19 remains within the casing bowl 5, restrained by the retaining ring 30 to the outer sleeve 18. The outer sleeve 18 maintains a seal to the casing bowl 5, restrained thereto with the holddown screws 15. Possibility for a blowout of the annular fluids is eliminated.

The BOP is lowered over the inner sleeve 19 and secured to the casing bowl flange 14. The holddown screws 15 are backed-out to release the outer sleeve 18. A pup shaft is connected to the top of the inner sleeve 19 and the entire swivel dognut assembly 16 and suspended tubing string 3 is safely pulled from the well.

From the foregoing, it is apparent that the present invention is characterised by the following advantages:

—the tubing rotator housing is removable without disturbing the tubing string;

—safety is enhanced during servicing as the tubing rotator maintains containment of the annular fluids until the BOP is in place and the holddown screws are retracted;

—the drive housing maintains the original strength of the casing bowl for connection of the non-rotating wellhead components, swivelling functions being performed by the swivel dognut assembly;

—the tubing rotator height is minimized by incorporating the swivel function within the rotator assembly and recessing the sleeves within the casing bowl bore;

—the straight-cut ring gear and worm are forgiving of vertical misalignment due to a cocked inner sleeve or variable housing elevation;

—fluid leaks to the environment are minimized by elimination of an external swivel, and by a two stage annular seal system to the environment, sealing fluids first at points on the swivel dognut assembly, and secondarily at the conventional flange seals.

The main feature of the invention is recessing or seating the sleeves within the casing bowl bore, to improve the compactness of the tubing rotator. One might choose not to lock the sleeves together with means, for example, such as the retaining ring 30 or choose not to lock the outer sleeve to the casing bowl with the holddown screws 15. These variants, although not as desirable as applicant's complete assembly, are considered to be within the scope of the invention.

The embodiments of the invention in which an exclusive property of privilege is claimed are defined as follows:

1. A tubing rotator for suspending and rotating a tubing string within a well casing string, which casing string is attached to a generally tubular casing bowl at a wellhead, said generally tubular casing bowl having a bore therethrough to permit passage of said tubing string, said casing string and said tubing string forming an annulus between them, and said casing bowl having holddown means, said rotator comprising:

a swivel dognut assembly having a generally tubular outer sleeve supportable rigidly with respect to said casing bowl so as to extend downwardly within the casing bowl, said outer sleeve having an outer surface;

an inner sleeve within the outer sleeve and rotatably and sealingly joined thereto, said inner sleeve being connectable at its lower end to the tubing string;

said inner and outer sleeves together sealingly blocking the top of said annulus;

said holddown means being operative when engaged to restrain the outer sleeve from vertical upward displacement; and means for rotating the inner sleeve.

2. A tubing rotator as claimed in claim 1, in which said outer sleeve extends downwardly in the casing bowl at least to the level of the holddown means, and said outer sleeve has at least one recess in its outer surface to receive the holddown means, whereby to cause the said restraint of the upper sleeve against vertical upward displacement.

3. A tubing rotator as set forth in claim 2 comprising means for releasably locking said inner and outer sleeves together to prevent relative rotation therebetween.

4. A tubing rotator as set forth in claim 1, the casing bowl having a casing bowl flange extending therefrom and the rotator additionally comprising:

a housing mounted above the casing bowl flange;

a gear train within the housing connectable to said inner sleeve and a source of motive power whereby to rotate the inner sleeve when power is applied from said source of motive power; and means for releasably locking said inner and outer sleeves together to prevent relative rotation therebetween so that the housing and at least a portion of the gear train can be disconnected and removed from the casing bowl while the tubing string and swivel dognut assembly are restrained in the casing bowl by the holddown means to seal said annulus, thereby permitting a blowout preventer to be lowered to engage the casing bowl.

5. The tubing rotator as recited in claim 4 wherein the gear train comprises a straight-cut ring gear connected to the inner sleeve and two straight worm gears which driveably engage with the straight-cut ring gear when the housing is positioned above the casing bowl flange and which disengage completely from the ring gear when the housing is removed axially from the inner sleeve, 6. The tubing rotator as recited in claim 1, the casing bowl having a casing bowl flange extending therefrom and the rotator comprising:

a housing mounted above the casing bowl flange;

a bearing means supported on an inner surface of the outer sleeve;

first seal means for sealing the outer sleeve to the casing bowl;

second seal means for sealing the inner sleeve to the outer sleeve below the bearing means to prevent annular fluid from contacting the bearing means or reaching the housing; and third seal means for sealing the inner sleeve to the housing above the first means to prevent tubing string fluids from contacting the first and second means.

7. The tubing rotator as recited in claim 2, the casing bowl having a casing bowl flange extending therefrom and the rotator comprising:

a housing mounted above the casing bowl flange;

a bearing means supported on an inner surface of the outer sleeve;

first seal means for sealing the outer sleeve to the casing bowl;

second seal means for sealing the inner sleeve to the outer sleeve below the bearing means to prevent annular fluid from contacting the bearing means or reaching the housing; and third seal means for sealing the inner sleeve to the housing above the first means to prevent tubing string fluids from contacting the first and second means.

8. The tubing rotator as recited in claim 3, the casing bowl having a casing bowl flange extending therefrom and the rotator comprising:

a housing mounted above the casing bowl flange;

a bearing means supported on an inner surface of the outer sleeve;

first seal means for sealing the outer sleeve to the casing bowl;

second seal means for sealing the inner sleeve to the outer sleeve below the bearing means to prevent annular fluid from contacting the bearing means or reaching the housing; and third seal means for sealing the inner sleeve to the housing above the first means to prevent tubing string fluids from contacting the first and second means.

9. The tubing rotator as recited in claim 4 comprising:

a bearing means supported on an inner surface of the outer sleeve;

first seal means for sealing the outer sleeve to the casing bowl;

second seal means for sealing the inner sleeve to the outer sleeve below the bearing means to prevent annular fluid from contacting the bearing means or reaching the housing; and third seal means for sealing the inner sleeve to the housing above the first means to prevent tubing string fluids from contacting the first and second means.

10. The tubing rotator as recited in claim 5 comprising:

a bearing means supported on an inner surface of the outer sleeve;

first seal means for sealing the outer sleeve to the casing bowl;

second seal means for sealing the inner sleeve to the outer sleeve below the bearing means to prevent annular fluid from contacting the bearing means or reaching the housing; and third seal means for sealing the inner sleeve to the housing above the first means to prevent tubing string fluids from contacting the first and second means.

11. A tubing rotator as set forth in claim 1, for use with a said casing bowl which has an inwardly tapering segment which becomes smaller in a downward direction, the outer sleeve of said rotator being provided with a tapered portion adapted to be supported by the said tapered segment of the casing bowl.

12. A tubing rotator as set forth in claim 11, including sealing means for sealing between said tapered portion of the inner sleeve and said tapered segment of the casing bowl.

13. A tubing rotator as set forth in claim 4, for use with a said casing bowl which has an inwardly tapering segment which becomes smaller in a downward direction, the outer sleeve of said rotator being provided with a tapered portion adapted to be supported by the said tapered segment of the casing bowl.

14. A tubing rotator as set forth in claim 13, including sealing means for sealing between said tapered portion of the inner sleeve and said tapered segment of the casing.

* * * * *